US005419082A

United States Patent [19]

Li

[11] Patent Number: 5,419,082

[45] Date of Patent: May 30, 1995

[54] WINDOW ASSEMBLY

[76] Inventor: Lee-Mao Li, No. 31, Section 3, Ren Ai Road, Tan Tz Hsiang, Taichung Hsien, Taiwan, Prov. of China

[21] Appl. No.: 302,200

[22] Filed: Sep. 8, 1994

[51] Int. Cl.[6] ..... E06B 7/096

[52] U.S. Cl. ..... 49/82.1; 49/51; 49/64

[58] Field of Search ..... 49/82.1, 64, 51

[56] References Cited

U.S. PATENT DOCUMENTS

| | | | |
|---|---|---|---|
| 135,246 | 1/1873 | Rodden | 49/82.1 |
| 1,479,452 | 1/1924 | Canavan | 49/82.1 |
| 2,112,634 | 3/1938 | Pilant | 49/82.1 X |
| 2,272,722 | 2/1942 | Morin | 49/82.1 |
| 2,651,085 | 9/1953 | Kopp | 49/82.1 X |
| 2,758,834 | 8/1956 | Sanford et al. | 49/82.1 |
| 2,857,634 | 10/1958 | Garbade et al. | 49/82.1 X |
| 2,898,035 | 8/1959 | Wheeler | 49/82.1 X |
| 3,350,814 | 11/1967 | Dufrene | 49/82.1 |
| 3,460,289 | 8/1969 | Toth | 49/82.1 X |
| 5,179,802 | 1/1993 | Higton | 49/64 X |

*Primary Examiner*—Philip C. Kannan
*Attorney, Agent, or Firm*—Charles E. Baxley

[57] ABSTRACT

A window includes a frame and a number of beams rotatably supported in the frame. The beams each includes a pinion formed in the middle portion. A number of panels are secured to the beams and rotated in concert with the beams. A rod is vertically disposed in the frame and includes a number of worm gears for engaging with the pinions such that the beams and the panels may be rotated by the rod when the rod is rotated. The rod may also be rotated by a motor. The window includes a configuration safety enough for protecting against burglars and for use as a sunshade.

2 Claims, 3 Drawing Sheets

WINDOW ASSEMBLY

BACKGROUND OF THE INVENTION

1. Field of the Invention

The present invention relates to a window assembly, and more particularly to a multi-function window assembly.

2. Description of the Prior Art

Typical windows comprise two panels which are normally made of glass materials and which may be easily opened by burglars, such that window grille is further required for safety purposes. In addition, typical windows may not be used as sunshade such that venetian blinds are further required for shading purposes.

The present invention has arisen to mitigate and/or obviate the afore-described disadvantages of the conventional windows.

SUMMARY OF THE INVENTION

The primary objective of the present invention is to provide a multi-function window assembly which can be used as windows, light shades and window grille.

In accordance with one aspect of the invention, there is provided a window assembly comprising a frame; a plurality of spaced beams horizontally disposed in the frame and rotatably supported in the frame, the beams each including a middle portion having a pinion provided thereon, a plurality of panels secured to the beams and rotated in concert with the beams, a rod vertically disposed in the frame and including a plurality of gearing means formed thereon for engaging with the pinions, the beams and the panels being rotated by the rod via the gearing means and the pinions when the rod is rotated.

The window assembly further includes a motor, a first gear engaged with the motor, a second gear secured to the rod and engaged with the first gear such that the rod is rotated by the motor when the motor is energized.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
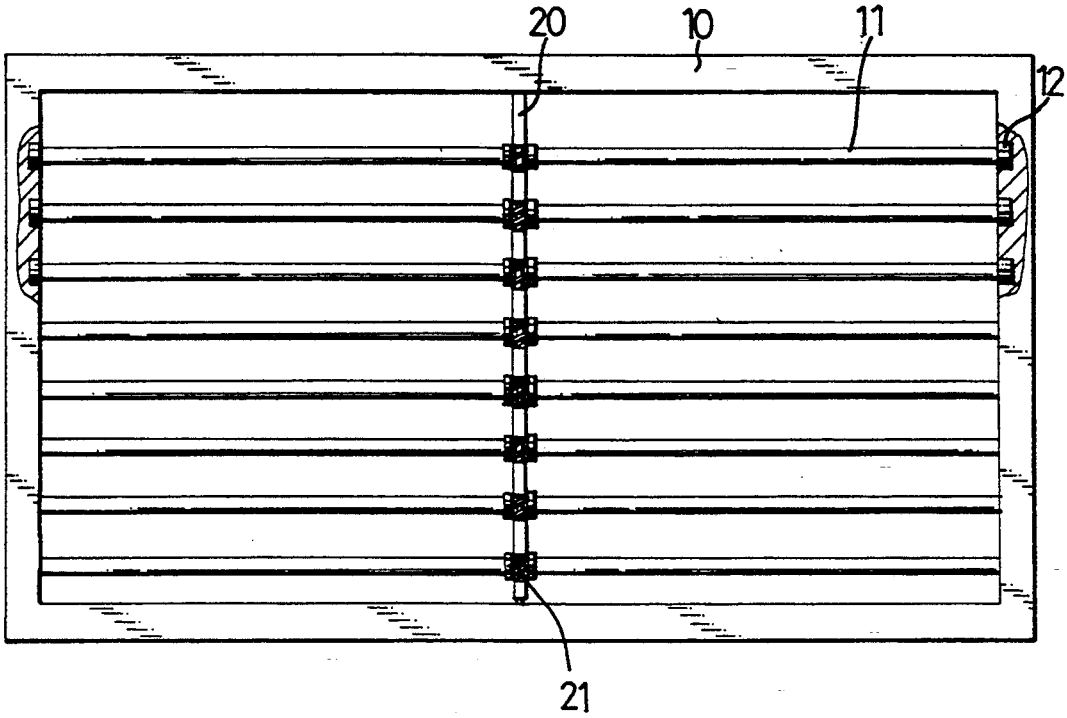
FIG. 1 is a plane view of a window assembly in accordance with the present invention, in which part of the window frame is cut off for illustrating the interior of the window frame.
Figure 2:
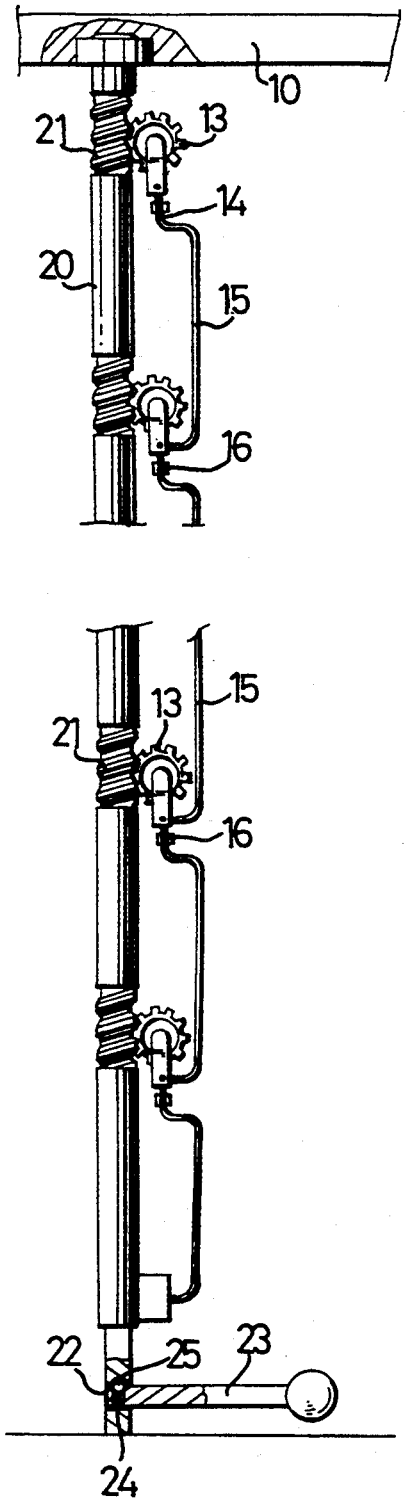
FIGS. 2 and B are side views illustrating the operation of the window assembly.

Referring to the drawings, and initially to FIGS. 1 and 2, a window assembly in accordance with the present invention comprises a frame 10 which is substantially rectangular. A number of spaced beams 11 are horizontally disposed in parallel in the frame 10 and include end portions rotatably supported in the frame 10 by bearing means 12 such that the beams 11 are rotatable. The beams 11 each includes a pinion 13 formed in the middle portion and each includes a flange 14 extended therefrom. A number of window panels 15 are secured to the flanges 14 by fastening means 16, such as bolts and nuts, such that the panels 15 are rotated in concert with the beams 11. The panels 15 may engage with one another for enclosing the frame 10. It is preferable that the beams 11 and the panels 15 are made of steel materials so as to form safety configuration against burglars. A rod 20 is disposed vertically in the middle portion of the frame 10 and includes a number of worm gears 21 formed thereon for engaging with the pinions 13 such that the beams 11 and the panels 15 may be rotated by the rod 20 when the rod 20 is rotated.

Figure 3:
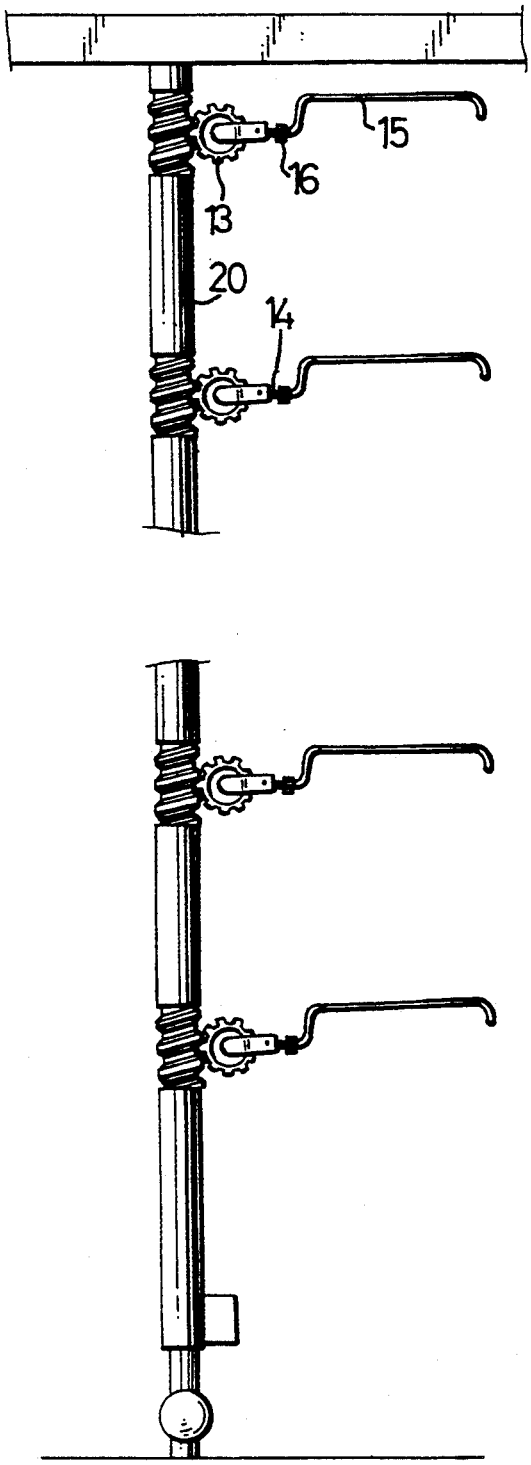

As shown in FIG. 2, a handle 23 may include a spring 24 and a ball 25 engaged in one end thereof which is engaged in an orifice 22 of the rod 20 such that the rod 20 may be easily rotated by the handle 23 in order to operate the panels 15. As shown in FIG. 3, the panels 15 form sunshade.

Figure 4:
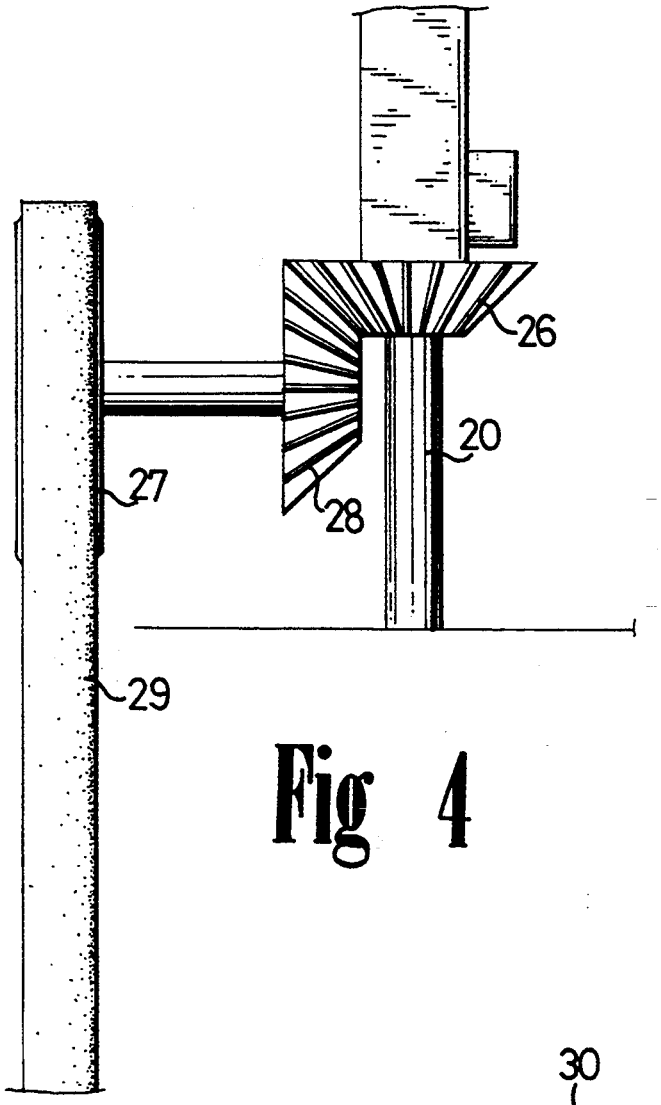
FIGS. 4 and 5 are schematic views illustrating two applications of the window assembly.

Referring next to FIG. 4, instead of the handle 23, a gear 26 may be secured to the rod 20, another gear 28 is provided for engaging with the gear 26 and secured to a pulley 27 to which a belt 29 or a chain means is coupled; such that, when the frame 10 is disposed in high position of a wall member, such as the wall member of factories, the rod 20 may be easily rotated by the motor or operated manually by the chain means.

Figure 5:
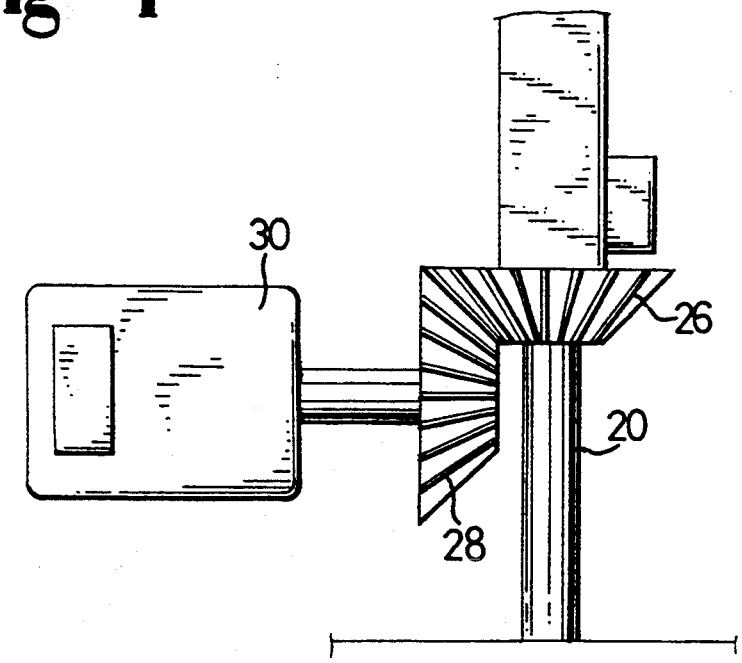

Referring next to FIG. 5, the gear 28 may be directly engaged with the motor 30 such that the rod 20 may be rotated by the motor 20.

Accordingly, the window assembly in accordance with the present invention includes a configuration that is safety enough for protecting against burglars and that can be used as sunshade.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A window assembly comprising:

a frame;

a plurality of spaced beams horizontally disposed in said frame and rotatably supported in said frame, said beams each including a middle portion having a pinion provided thereon, a plurality of panels secured to said beams and rotated in concert with said beams, a rod vertically disposed in said frame and including a plurality of gearing means formed thereon for engaging with said pinions, said beams and said panels being rotated by said rod via said gearing means and said pinions when said rod is rotated.

2. A window assembly according to claim 1 further comprising a motor, a first gear engaged with said motor, a second gear secured to said rod and engaged with said first gear such that said rod is rotated by said motor when said motor is energized.

* * * * *